US010012145B1

(12) United States Patent
Araujo

(10) Patent No.: US 10,012,145 B1
(45) Date of Patent: Jul. 3, 2018

(54) INTERNAL COMBUSTION ENGINE WITH COAXIALLY ALIGNED PISTONS

(71) Applicant: Alberto Francisco Araujo, Miramar, FL (US)

(72) Inventor: Alberto Francisco Araujo, Miramar, FL (US)

( * ) Notice: Subject to any disclaimer, the term of this patent is extended or adjusted under 35 U.S.C. 154(b) by 0 days.

(21) Appl. No.: 15/828,594

(22) Filed: Dec. 1, 2017

(51) Int. Cl.
*F02B 75/24* (2006.01)
*F02B 25/06* (2006.01)
*F02B 25/08* (2006.01)

(52) U.S. Cl.
CPC ..... *F02B 75/243* (2013.01); *F02B 25/06* (2013.01); *F02B 25/08* (2013.01); *F02B 2275/40* (2013.01); *F02B 2700/03* (2013.01)

(58) Field of Classification Search
CPC ..... F02B 75/243; F02B 75/246; F02B 75/24; F02B 25/06; F02B 25/08; F02B 2700/03; F02B 2275/40
See application file for complete search history.

(56) References Cited

U.S. PATENT DOCUMENTS 2,516,669 A * 7/1950 Beck ..... F02B 75/243 123/55.4
4,058,104 A * 11/1977 Swoager ..... F02F 3/00 123/193.4
4,359,975 A 11/1982 Heidner
4,362,132 A 12/1982 Neuman
4,715,336 A * 12/1987 Schindler ..... F01B 9/02 123/318
5,628,295 A 5/1997 Todero et al.
5,992,358 A 11/1999 Otome
6,267,088 B1 7/2001 Rosskamp et al.
6,843,213 B2 1/2005 Saad et al.
8,899,194 B2 12/2014 Engel
2003/0217709 A1 11/2003 Geyer et al.
2006/0180106 A1 8/2006 Osburg et al.
2016/0097344 A1 4/2016 Yamazaki et al.

* cited by examiner

*Primary Examiner* — Jacob Amick
(74) *Attorney, Agent, or Firm* — The Concept Law Group, PA; Scott D. Smiley

(57) ABSTRACT

An internal combustion engine using a two stroke cycle includes a pair of opposing cylinder units, each of which are located on opposing sides of a crankcase. In each cylinder unit is a cylinder with a piston disposed in the cylinder. Each piston is coupled to a piston rod that is aligned along an axis that passes through the center of each cylinder bore. The piston rods pass through the crankcase wall into the crankcase chamber, and are further coupled to a yoke. Each cylinder unit has an intake channel from the crankcase chamber to a cylinder intake port in the cylinder. As the piston traverses its upstroke in its cylinder, it creates a vacuum under the piston. At the top of its stroke a piston intake port becomes aligned with the cylinder intake port, allow fuel to be drawn into the cylinder under the piston. As a result, a continuous vacuum is experienced in the crankcase without the need for mechanical valving arrangements.

20 Claims, 15 Drawing Sheets

INTERNAL COMBUSTION ENGINE WITH COAXIALLY ALIGNED PISTONS

FIELD OF THE INVENTION

The present invention relates generally to internal combustion engines, and more particularly to internal combustion engines in a free piston configuration.

BACKGROUND OF THE INVENTION

It is well known by persons familiar with the free piston engine that it is comprised of pairs of cylinders with each pair coaxially aligned and disposed back to back with the piston rods extending from the pistons reciprocating in each of these cylinders also coaxially aligned and being joined by a yoke. Perhaps the most well-known free piston engine arrangement is the so-called Bourke engine, named after Russel Bourke. In a free piston engine the center of the yoke is transversely slotted to receive the throw of a crank so that, as each pair of pistons and their yoke-joined piston rods reciprocate as a unit, the crank throw will not only be reciprocated with and in the direction of the yoke, but it will also reciprocate transversely in the yoke slot. Thereby, there is imparted to the crank shaft the desired rotary driving motion from the reciprocation of the paired pistons which are interconnected through their rods and the yoke to move reciprocally as a unit. Bourke engines have been the subject of U.S. Pat. Nos. 2,122,676, 2,122,677 and 2,172,670 and the history and details of which engines are more fully described in a publication entitled "Bourke Engine Documentary" by Lois Bourke, wife of inventor Russel Bourke, copyrighted by the author in 1968, and printed by D. D. Enterprises of North Hollywood, Calif. 91601.

As for the lubrication system design of the Bourke engine, the crankcase includes a lubrication sump system where the crankcase is filled with oil as normally seen in conventional four stroke engines and is separated from the cylinder heads, which consequently operate as more of conventional two stoke engine. The oil within the crankcase is used to lubricate the main crankshaft bearings, the yolk bearings and the piston connecting rods and their respective bearings by means of a simple rotating splash method. In addition, oil from the crankcase is transferred via a small conduit to the cylinders and is strategically positioned to drip oil on the piston rings as they reach bottom dead center. As seen by evidence in actual Bourke engines built over the years, and as seen on the actual Bourke engine which was recently discovered, the oil from the crankcase migrates into the combustion chamber by leakage at the connecting rod bearing seals. Furthermore the oiling method used for the described piston rings allows excess oil to also drip into the combustion chamber. This passage of oil from the crankcase into the combustion chamber results in an excessive buildup of burned oil seen as a varnish buildup within the bottom end of the cylinders and the actual combustion side of the cylinder heads.

In the fuel and air induction system of Bourke engines, it is important to make note of the fact that the Bourke engine would not run on conventional pump gas. It would only run on a blend of two parts heavy fuel mixed to one part of white gas which further contributed to its resistance for becoming a main stream power plant of choice. The Bourke engine uses an intake manifold that is secluded from the oil filled crankcase. Air enters a carburetor that is attached to the intake manifold, it is mixed with fuel and then travels down the intake manifold to be pulled into the underside of the piston cavity which creates a vacuum as the piston travels upward on the compression stroke. As the piston moves downward on the power stroke the piston skirt closes the intake ports and compresses the induction charge underneath the piston. This compressed induction charge is not displaced within the crankcase as seen with all conventional two stroke engines. Prior to reaching the bottom of the piston travel a set of intake transfer ports allow the fuel mixture to enter the cylinder, fill the cylinder with a fresh fuel air charge, and scavenge the burnt exhaust gasses by means of allowing the exhaust to exit via the exhaust port.

While the theory and principle of operation of the Bourke engine are such that this engine offers many advantages over some more conventional internal combustion engines, certain mechanical problems along with a custom non pump gas specific fuel mixture have been observed in Bourke type engines which have heretofore been built and tested, and these problems appear to have contributed to the apathy of engine builders toward the Bourke engine.

For one, given the fact that a substantial amount of fuel air pressure is present underneath the piston as it reaches bottom dead center, the sealing methods available at the time and even under current times, allow leakage of the said fuel air charge to migrate into the oil filled crankcase area which results in an undesirable pressure increase within the oil filled crankcase. In addition the vacuum that is created as the piston travels upward on the compression stoke causes oil to be pulled into the lower section of the cylinder and therefore contaminating the fuel air charge with oil from within the crankcase.

Furthermore, the Bourke engine design was also based on a combustion cycle principal that to this day has never been validated and according to experts in the field is not plausible. Claims were made that the carbon fuels were compressed and ignited simultaneously during the compression stroke cycle causing both heat and pressure to release hydrogen molecules that would then greatly contribute to the power available from the fuel air charge being burned. As a result the Bourke engine combustion chamber and cylinder head did not utilize proper combustion chamber designs to maximize proper flame front propagation and fuel burn. It is the opinion of some that what is occurring is the early undocumented discovery of what is known today to be homogeneous charge compression ignition (HCCI). As a result the Bourke free piston engine needed to be run at a specific compression ratio for a given days atmospheric conditions with specific timing curves and a custom blended fuel in order to properly induce what was apparently the first undocumented HCCI engine operation. According to Russell Bourke, the Bourke engine cycle ran on a much leaner fuel air mixture than conventional IC engines, it would self-ignite under what he called the detonation cycle, and would run cold due to what he referred to as the refrigeration cycle of the burnt expanding gas as the piston traveled down on the power stroke and increased the volumetric cylinder area. It is the present understanding that HCCI requires a very specific compression pressure and temperature along with a leaner homogeneous fuel air charge which, when compression ignited, does not produce a flame front, and therefor contributes to lower exhaust gas temperatures common with what Bourke referred to as the refrigeration cycle.

Therefore, a need exists to overcome the problems with the prior art as discussed above.

SUMMARY OF THE INVENTION

The invention provides an internal combustion engine with axially aligned pistons that overcomes the hereinaforementioned disadvantages of the heretofore-known devices and methods of this general type and that creates a continuous vacuum in the crankcase. The engine operates using a two stroke cycle, and operates on conventional commercial grade gasoline.

With the foregoing and other objects in view, there is provided, in accordance with some embodiments, an internal combustion engine includes a crankcase having a crankcase chamber. A pair of opposing cylinder units are disposed on opposing sides of the crankcase along an axis. Each cylinder unit include a cylinder with a piston disposed therein. Each piston is coupled to a piston rod that is oriented along the axis from the cylinder into the crankcase chamber. A yoke is disposed in the crankcase chamber to which each of the piston rods are coupled on opposite sides of the yoke. In each cylinder unit there is an intake channel passing from the crankcase chamber to a respective intake port in the cylinder. Wherein a piston intake port aligns with the cylinder intake port when the piston is at the top of a stroke in the cylinder, and is sealed off by the skirt otherwise, and fuel is drawn under the piston in the cylinder by a vacuum created under the piton as the piston moves up in the cylinder. Each cylinder unit further includes a transfer channel between a lower cylinder transfer port and an upper cylinder transfer port in the cylinder through which fuel is transferred from under the piston through a piston transfer port to a top of the cylinder above the piston when the piston at a bottom of the stroke. The action of the pistons oscillating laterally along the axis in opposition to each other creates a continuous vacuum in the crankcase chamber. That means, one of the pistons is always moving away from the chamber and creating a vacuum as it does so. The opposing piston moving towards the chamber is not pressurizing the chamber because it is not fludically connected to the chamber because the piston skirt block the port. Instead, the air/fuel mixture beneath the piston is being transferred around the piston and to the top of the piston inside the cylinder. As used herein, the term "continuous vacuum" does not necessarily mean that the pressure in the chamber is never zero or that there is never an instant of positive pressure. It is intended to differentiate the present invention from known engines that positively pressurize the chamber by forcing air/fuel mixtures from under the piston back into the chamber 110.

In accordance with another feature of some embodiments, the internal combustion engine further includes a crankcase intake port through which fuel is introduced into the crankcase chamber, and wherein the stroke of each piston draws fuel from the crankcase chamber, though the intake channel, cylinder intake port, and piston intake port under the piston in each cylinder unit at the top of the stroke.

In accordance with a further feature of some embodiments of the present invention, in each cylinder unit, fuel is compressed under the piston as the piston traverses from the top to the bottom of the stroke, whereupon the compressed fuel escapes under pressure resulting from the compression through a piston transfer port and lower cylinder transfer port, through the transfer channel and upper cylinder transfer port into a top of the cylinder.

In accordance with a further feature of some embodiments of the present invention, the upper transfer port in each cylinder is sealed off by the skirt of the piston except when the piston is at the bottom of the stroke.

In accordance with a further feature of some embodiments of the present invention, the yoke has a transverse slot therein, and a crank in the crankcase chamber has a crank throw that is disposed in the transverse slot of the yoke. The crank throw reciprocates transversely in the slot as the pistons and piston rods reciprocate longitudinally, and the crank throw thereby follows a circular path within the crankcase which imparts a rotational force to the crank. The fuel includes a lubricating component that lubricates the yoke, crank, crank throw, piston rods in the crankcase chamber, and to the pistons through the respective intake channels.

In accordance with some embodiments of the present invention, a method for operating an internal combustion engine is provided. The method includes providing a fuel into the crankcase chamber of the engine through an intake port of the crankcase. The method can further include pulling fuel from the crankcase chamber into the cylinder through an intake channel that passes from the crankcase chamber to a cylinder intake port in the cylinder by action of a vacuum created under the piston when the piston travels to a top of a stroke within the cylinder. This is facilitated by a skirt intake port in a skirt of the piston that aligns with the cylinder intake port when the piston at the top of the stroke. When the piston in each cylinder unit is at the top of its stroke, there is compressed fuel mixture above the piston in the cylinder. The method can further include compressing fuel under the piston by action of the piston traversing a down in the stroke as compelled by the fuel above the piston igniting. The method can further include transferring the compressed fuel under the piston to a top of the cylinder above the piston when the piston is at a bottom of the stroke through a transfer channel. The transfer is facilitated by a skirt transfer port of the piston that aligns with a lower cylinder transfer port of the transfer channel at the bottom of the stroke. As a result, a constant vacuum is created in the crankcase chamber.

Although the invention is illustrated and described herein as embodied in an internal combustion engine with coaxially aligned pistons, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein, however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected, it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the referenced structure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
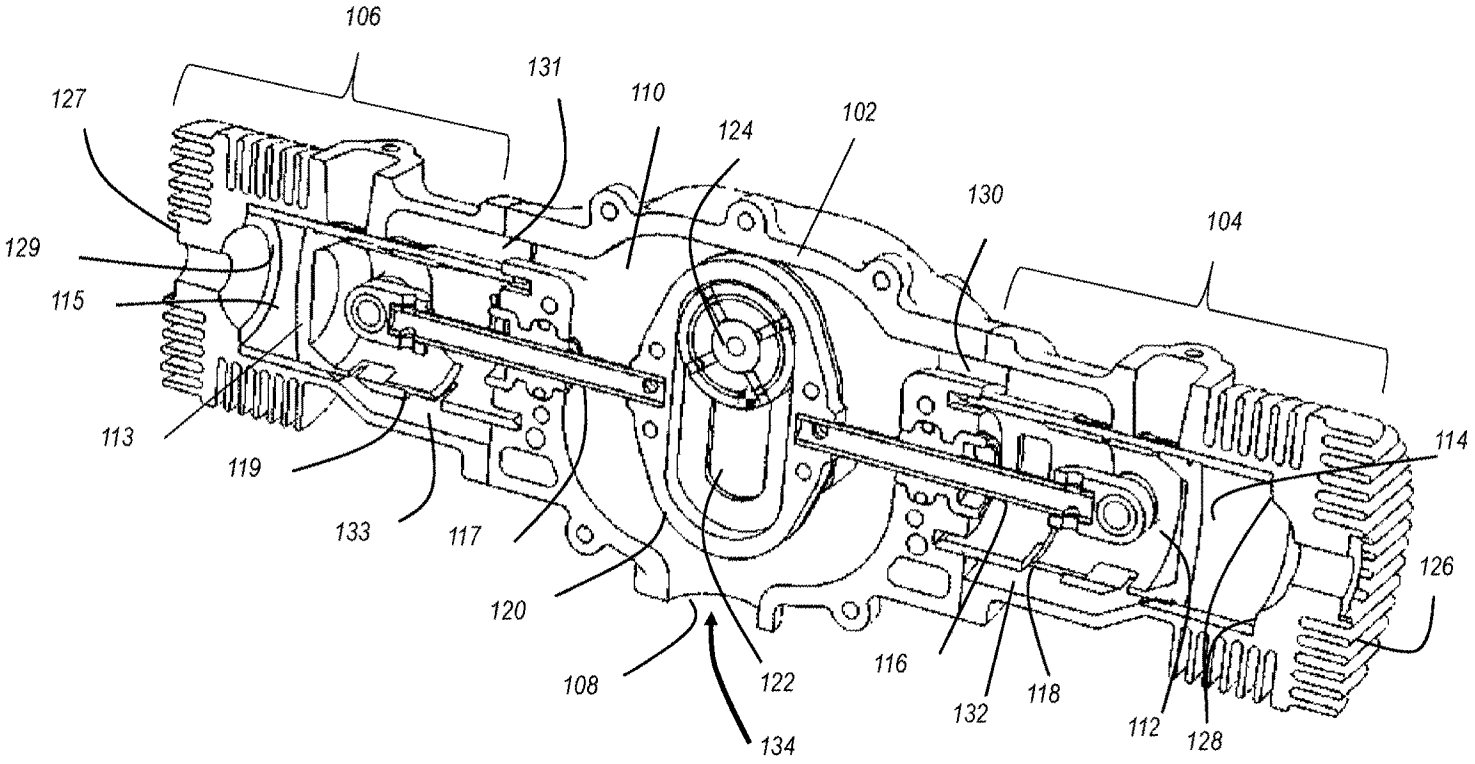
FIG. 1 shows an isometric cutaway view of an internal combustion engine in a first timing state, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient internal combustion engine arranged in a free piston configuration. Embodiments of the invention provide an internal combustion engine that includes a crankcase having a crankcase chamber with a pair of longitudinally opposing cylinder units coupled on respective opposing sides of the crankcase. Each cylinder unit includes a cylinder therein, an intake channel from the crankcase chamber to a cylinder intake port in a side of the cylinder, a transfer channel from a lower cylinder transfer port in the side of the cylinder to an upper cylinder transfer port in the side of the cylinder, and a piston disposed in the cylinder and having a skirt. The skirt has a skirt intake port that corresponds to and aligns with the cylinder intake port when the piston is at a top of a stroke in the cylinder and the skirt otherwise seals off the cylinder intake port through a bottom of the stroke. The skirt further includes a transfer port that, at the bottom of the stroke, corresponds and aligns with the lower cylinder transfer port wherein the upper cylinder transfer port is opened when the piston is at the bottom of the stroke. The upper cylinder transfer port is sealed off by the skirt during the remainder of the stroke. The stroke of each of the pair of longitudinally opposing cylinder units are offset by 180 degrees with respect to each other.

In the following drawings FIGS. 1-9 each show an isometric cutaway view of an internal combustion engine throughout successive angles of stroke. In particular, the internal combustion engine of FIGS. 1-9 is arranged in accordance with a free piston engine design which uses opposing cylinders with pistons joined to a common yoke inside the crankcase. As such, each piston's stroke is offset by 180 degrees from the other; when one piston is at top dead center of its stroke, the other piston will be at bottom dead center of its stroke, and vice versa.

FIGS. 1-9 show several advantageous features of embodiments of the present invention, but, as will be described below, the invention can be provided in several shapes, sizes, combinations of features and components, and varying numbers and functions of the components. The first example of an internal combustion engine as shown in FIGS. 1-9, includes a crankcase 102 having a crankcase chamber 110 therein, with opposing cylinder units 104, 106 on either side of the crankcase 102. For the sake of example, cylinder unit 104 can be referred to herein as the right cylinder unit, and cylinder unit 106 can be referred to as the left cylinder unit simply because, as shown, they are located on the right and left sides, respectively, of the crankcase 102. The crankcase 102 includes an intake port 108 through which fuel 134 is provided. The fuel 134 can be standard commercial grade gasoline. In some embodiments, the fuel 134 can be a fuel mixture that includes gasoline and a lubricating component (e.g. oil) mixed together for embodiments where the crankcase 102 lacks a lubrication sump (e.g. oil pan/pump system).

Each of the cylinder units 104, 106 include a respective piston 112, 113 disposed in cylinder 114, 115. Each piston 112, 113 is connected to a respective piston rod 116, 117, that are both further connected to a yoke 120 in the crankcase 102 though the wall of the crankcase 102, and supported by seals and bearings, accordingly. The yoke 120, as the pistons 112, 113 move back and forth (i.e. left and right) throughout their respective strokes, is likewise driven to oscillate laterally between left and right positions. The yoke 120 includes a transverse (here, vertical) slot 122 in which the throw 124 of a crank is disposed. Thus, as the yoke 120 moves laterally, the crank throw 124 moves transversely in the slot 122, imparting a rotational motion to the crank (not shown).

As used herein, those skilled in the art will understand that referring to "top" and "bottom" of a cylinder, or the stroke of the piston within its corresponding cylinder, are relative to the cylinder, or to the motion of the piston in the cylinder, not necessarily with respect to, for example, the direction of gravity. As used herein the term "bottom," when referring to the cylinder or the stroke in the cylinder, means the portion of, or position in, the cylinder closest to the crankcase, while the "top" of the cylinder or stroke of the piston in the cylinder refers to a position in the cylinder farthest from the crankcase. Likewise, the term "bottom dead center" refers to the piston being at the lowest point of its stroke (closest to the crankcase) in the cylinder, while "top dead center" refers to the piston being at its highest point of its stroke (farthest from the crankcase) in the cylinder. These terms also relate to the angular position of the crank with respect to each piston's position in its respective stroke as well.

Each piston 112, 113 has a skirt 118, 119 in close relationship with a wall of the respective cylinder 114, 115. The wall of each cylinder 114, 115 has several ports through which either fuel/fuel mixture, or combustion products enter/exit the cylinder. For each cylinder unit 104, 106, there is a respective intake channel 130, 131 between the crankcase chamber 110 and a respective cylinder intake port in the wall of the respective cylinder 114, 115. In each piston 112, 113, formed through the skirt 118, 119, is a piston intake port that allows the fuel/fuel mixture to pass from the intake channel 130, 131, through the cylinder intake port, and through the piston intake port into the cylinder 114, 115 under the piston 112, 113. As each piston separately moves down in its stroke (while the other is moving up in its stroke), the fuel under the piston 112, 113 becomes compressed. At the bottom (not necessarily bottom dead center), of the stroke, the compressed fuel escapes from under the piston 112, 113, through a piston transfer port in the side of the piston 112, 113 that, at the bottom of the stroke aligns with a lower cylinder transfer port in the wall of the cylinder 114, 115, though a transfer channel 132, 133, and through an upper cylinder transfer port in the wall of the cylinder, into the cylinder above the piston 112, 113. Also when the piston 112, 113 is passing through the bottom of its stroke, it exposes and exhaust port in the side of the cylinder 114, 115, above the piston 112, 113 (again, while passing through the bottom of its stroke) to allow combusted fuel to exit the cylinder as new fuel is forced into the top portion of the piston 112, 113. Then as each piston 112, 113 commences back up in the cylinder 114, 115, it closes off the upper cylinder transfer and exhaust ports, and compressed the new fuel above the piston 112, 113. Ignition of the compressed fuel above the piston 112, 113 can occur when the piston 112, 113, reaches top dead center, or prior to, or after the piston reaches top dead center of its stroke.

Each cylinder unit 104, 106 further includes a cylinder head 126, 127 that forms a combustion chamber at the top of each cylinder 114, 115, into which fuel is compressed for detonation. In some embodiments each cylinder head 126, 127 can include a squish band 128, 129 formed around a circumferential perimeter of the combustion chamber that "squishes" the compressed fuel towards the center of the combustion chamber for a more efficient detonation of the fuel, as is known.

FIGS. 10-13 illustrate elements of internal combustion engine embodiments such as those shown in FIGS. 1-9 in clearer detail. It will be appreciated by those skilled in the art that although two cylinder units are shown in FIGS. 1-9, a single cylinder unit can be used, or more that two cylinder units can be used. Accordingly, it is expressly contemplated that a single cylinder unit can achieve a similar operation where the crankcase is operated at a negative pressure. Where common terms are used in describing FIGS. 10-13, it can be assumed that they correspond to similar elements in FIGS. 1-9 using the same terms, as well as to a single cylinder unit embodiment of an engine. The proportions and dimensions shown here are for example only, and not meant to imply any particular proportional arrangement. Those skilled in the art will further appreciate that other features that may be common in internal combustion engines, such as, for example, cooling features, are likewise not shown here to simplify the drawings.

Figure 10:
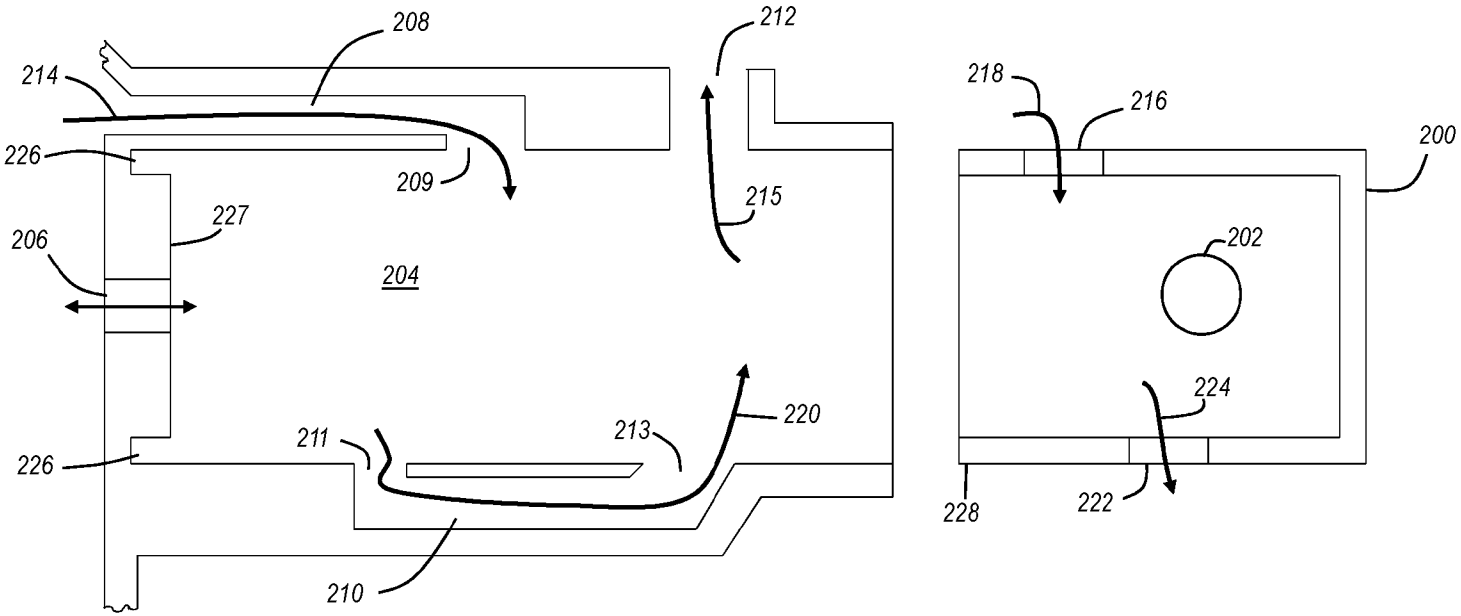
FIG. 10 shows a detailed exploded side cutaway view of a cylinder unit, in accordance with some embodiments.

FIG. 10 shows an exploded side cutaway view of a portion of a cylinder unit, in accordance with some embodiments. A piston 200 is shown outside of the cylinder 204 in which it resides during operation. The piston 200 includes a connecting rod 202 that is connected to a piston rod (not shown) though a passage 206 formed in the wall of the crankcase, wherein it moves laterally as indicated by the arrow. An intake channel 208 is formed in the cylinder unit wall, and provides a passage from the crankcase chamber (e.g. 110 of FIG. 1) to a cylinder intake port 209 formed in the wall of the cylinder 204 as indicated by arrows 214, 218. Thus, when cylinder intake port 209 is not blocked by the skirt 228 of the piston 200, fuel/fuel mixture can be drawn into the cylinder 204 at a lower or bottom portion of the cylinder, under the piston 200, through the intake channel 208 and cylinder intake port 209. Further, when the piston 200 is at the top of its stroke (e.g. +/−45 degrees from top dead center), a piston intake port 216 aligns/overlaps with the cylinder intake port 209, thereby allowing the fuel to enter under the piston 200. The fuel is drawn from the crankcase chamber by virtue of a vacuum created under the piston 200 as the piston 200 rises in the cylinder 204. While the piston 200 is not at the top portion of its stroke, the skirt 228 of the piston 200 seals off the cylinder intake port 209.

When the piston 200 moves down in its stroke (e.g. due to pressure cause by detonation of the fuel), the cylinder intake port 209 will become sealed off, and exhaust port 212 will be opened to the top portion of the cylinder 204, allowing exhaust to exit the cylinder. As the piston continues to move down in its stroke, the transfer process occurs, where fuel that has been compresses under the piston 200 is transferred from a portion of the cylinder 204 under the piston 200 to a top portion of the cylinder 204 above the piston 200. The transfer process occurs when a piston transfer port 222 in the skirt 228 of the piston 200 aligns with a lower cylinder transfer port 211 in the wall of the cylinder 204, and compresses fuel exits from under the piston 200 in the direction of arrow 224. When the piston 200 is at the bottom of its stroke (e.g. +/−45 degrees of bottom dead center), the upper cylinder transfer port 213 is opened to the cylinder 204 above the piston 200. A transfer channel 210 passes from the lower cylinder transfer port 211 to the upper cylinder transfer port 213, allowing fuel to transfer from under the piston 200 to above the piston 200 in an upper portion of the cylinder 204 above the piston 200. As the compressed fuel enters the top portion of the cylinder 204, it can help displace remaining exhaust through exhaust port 212 as indicated by arrow 215.

Figure 11:
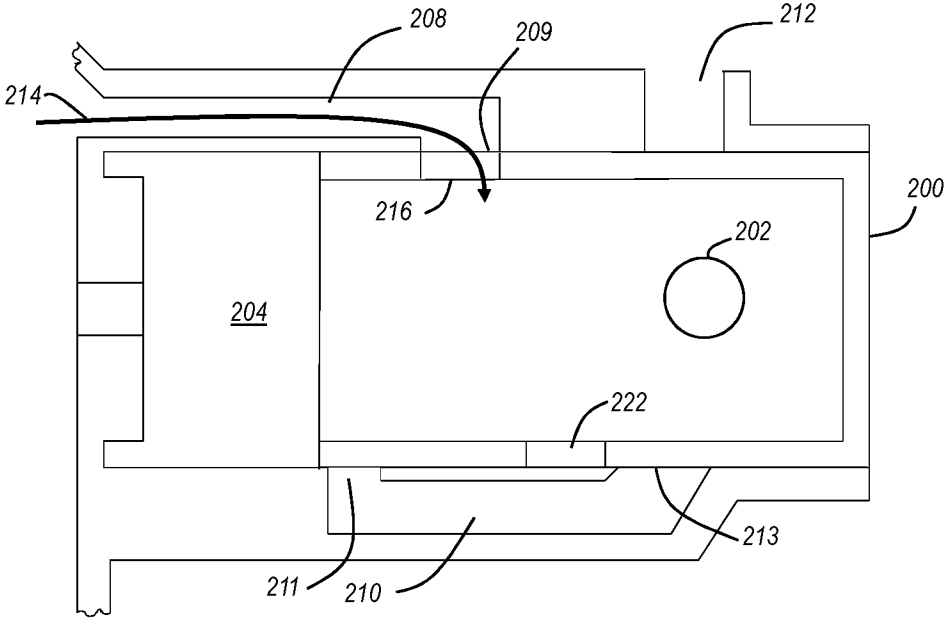
FIG. 11 shows a detailed side cutaway view of a cylinder unit with the piston at top dead center, in accordance with some embodiments.

The fuel intake operation is shown more particularly in FIG. 11, where the piston 200 is shown in the cylinder 204 at top dead center of its stroke. It can be assumed that as the piston 200 rises in the cylinder 204, a vacuum is created under it. Upon the piston intake port 216 in the skirt of the piston 200 aligning with the cylinder intake port 209 in the wall of the cylinder 204, fuel is drawn from the crankcase through the intake channel 208 as indicated by arrow 214. During the top portion of the stroke, the skirt of the piston 200 seal off the lower and upper cylinder transfer ports 211, 213, and piston transfer port 222 is likewise sealed against the wall of the cylinder 204. From this position at tope dead center of the stroke, the piston 200 will begin to travel down in the cylinder 204 due to the pressure created by detonation of fuel above the piston 200 (e.g. in a combustion chamber not shown here). As the piston 200 begins to move down, piston intake port 216 will move away from cylinder intake port 209, and the skirt of the piston 200 will seal off cylinder intake port 209 until the piston 200 returns to the top of its stroke.

Figure 12:
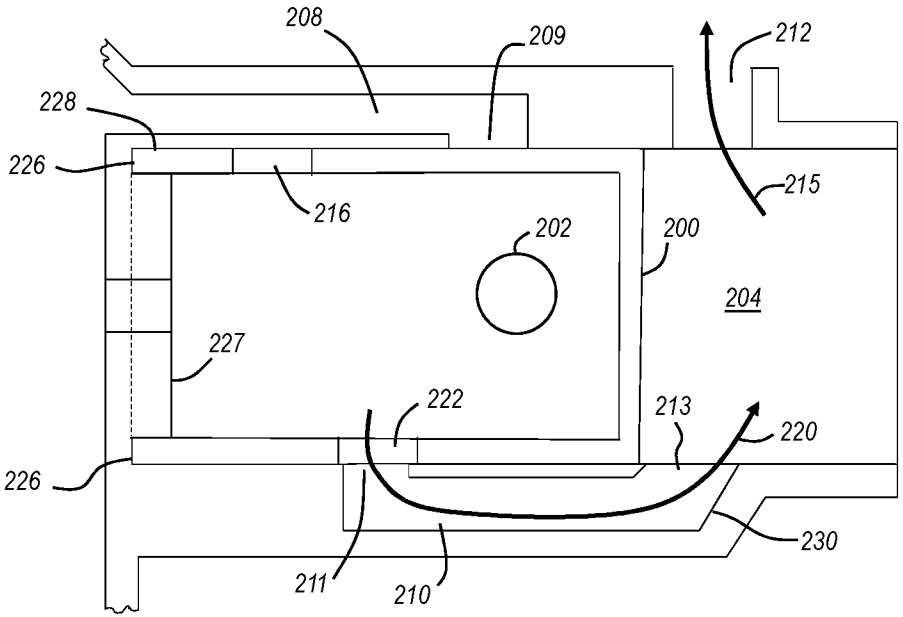
FIG. 12 shows a detailed side cutaway view of a cylinder unit with the piston at bottom dead center, in accordance with some embodiments.

The fuel transfer process is illustrated in FIG. 12, wherein piston 200 is shown in cylinder 204 at bottom dead center of its stroke. A lower portion of the skirt 228 can seat in a circumferential recess 226 at the bottom of the cylinder 204, allowing a raised portion 227 to fit up into the underside of the piston 200 to increase compression of the fuel under the piston 200. As the piston 200 is at the bottom of its stroke (e.g. +/−45 degrees of bottom dead center), the piston transfer port 222 becomes aligned with the lower cylinder transfer port 211, and the top of the piston 200 clears the upper cylinder transfer port 213, allowing the compressed fuel under the piston 200 to escape to the top of the cylinder along the path of arrow 220. An upper portion 230 of the cylinder transfer channel 210 can be angled to direct the compressed fuel escaping into the upper portion of the cylinder 204 towards a top of the cylinder 204 where the combustion chamber is formed by the cylinder head (not shown) to assist with displacing exhaust without causing a significant amount of fuel to pass through the exhaust port 212. As the piston 200 begins rising in the cylinder 204, the piston transfer port 222 moves up past the lower cylinder transfer port 211 where the skirt 228 of the piston 200 then seals off the lower cylinder transfer port. Likewise, the skirt of the piston 200 also closes off the upper cylinder transfer port 213 as the piston 200 travels upwards in the cylinder 204. Once the lower and upper cylinder transfer ports are closed off, a vacuum begins forming under the piston 200, and then the intake process commences, as illustrated in FIG. 11.

Figure 13:
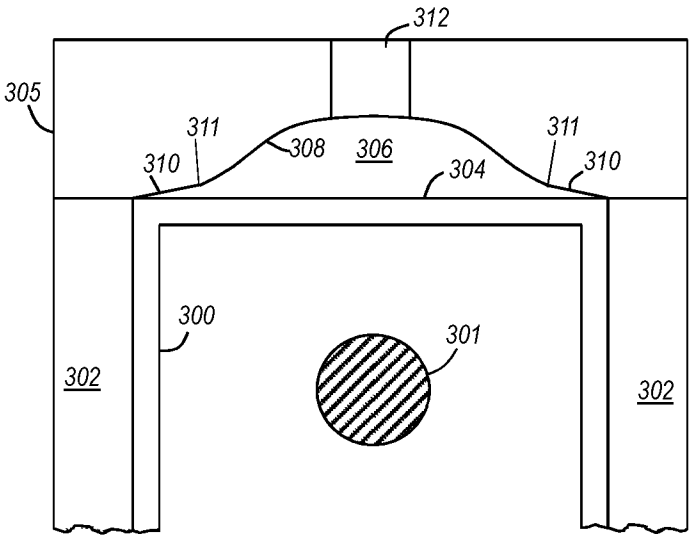
FIG. 13 shows a side cutaway view of a cylinder unit including a cylinder head, in accordance with some embodiments.

FIG. 13 shows a cross sectional view of a cylinder unit with the piston at top dead center, in accordance with some embodiments. A piston 300 is disposed in the bore of a cylinder formed by cylinder wall 302. A connecting rod 301 coupled the piston 300 to a piston rod (not shown). A cylinder head 305 is coupled to a top of the cylinder wall 302, and has a void 306 that forms a combustion chamber between a top 304 of the piston 300 and an upper surface 308 of the void 306. A squish band 310 is formed around the circumferential perimeter of the void 306 where the distance between the top 304 of the piston 300 and the upper surface 308 of the void tapers from nearly touching to an edge 311 over the top 304 of the piston 300. In some embodiments the squish band can be tapered from the cylinder wall to the edge 311, increasing clearance between the top of the piston towards the edge 311. The effect of the squish band 310 is to "squish" the fuel-air mixture into the void so that, upon detonation, the pressure is more uniformly distributed over the top 304 of the piston 300. Detonation can occur by compression heating (i.e. dieseling), or by spark provided by a spark plug (not shown) in a spark plug channel 312.

Figure 2:
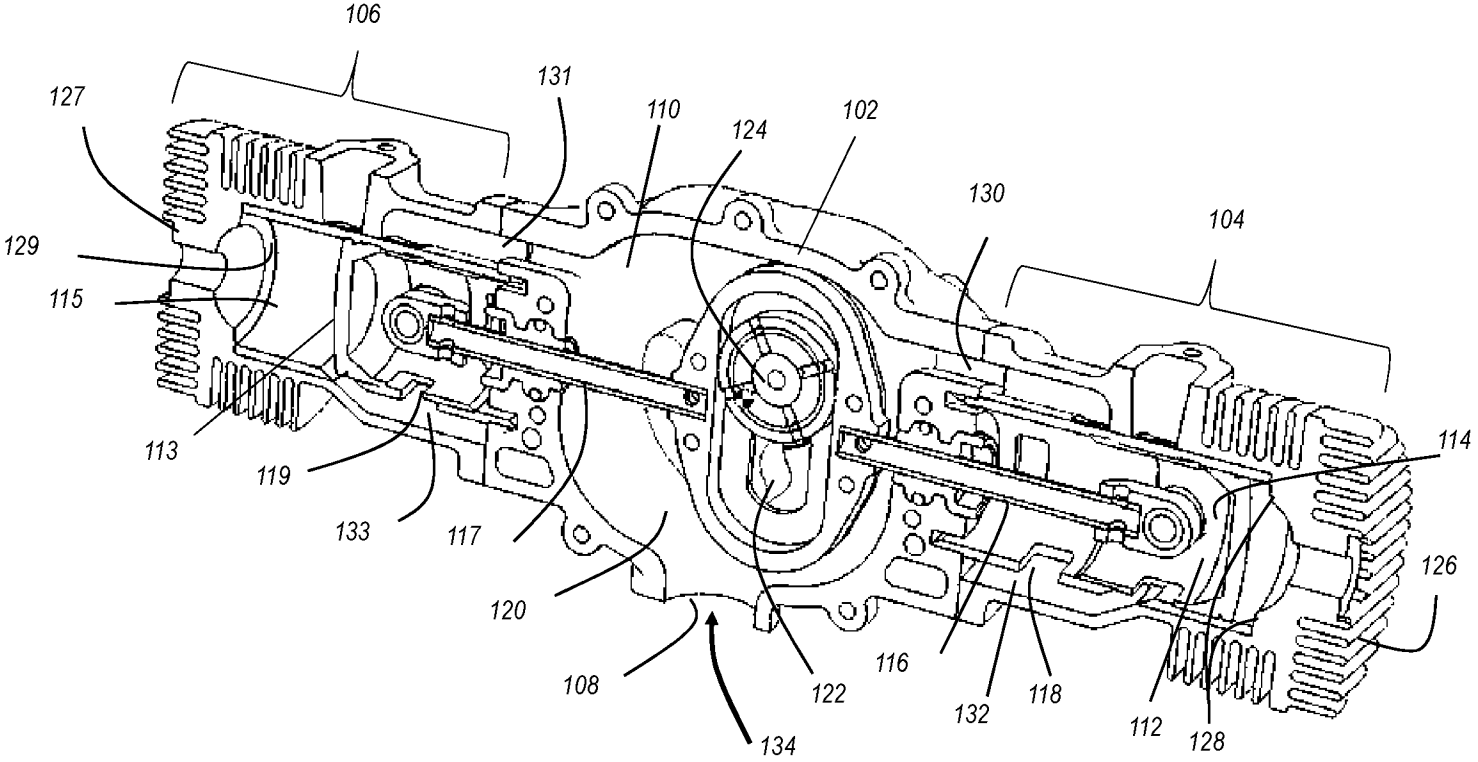
FIG. 2 shows an isometric cutaway view of an internal combustion engine in a second timing state, in accordance with some embodiments.
Figure 3:
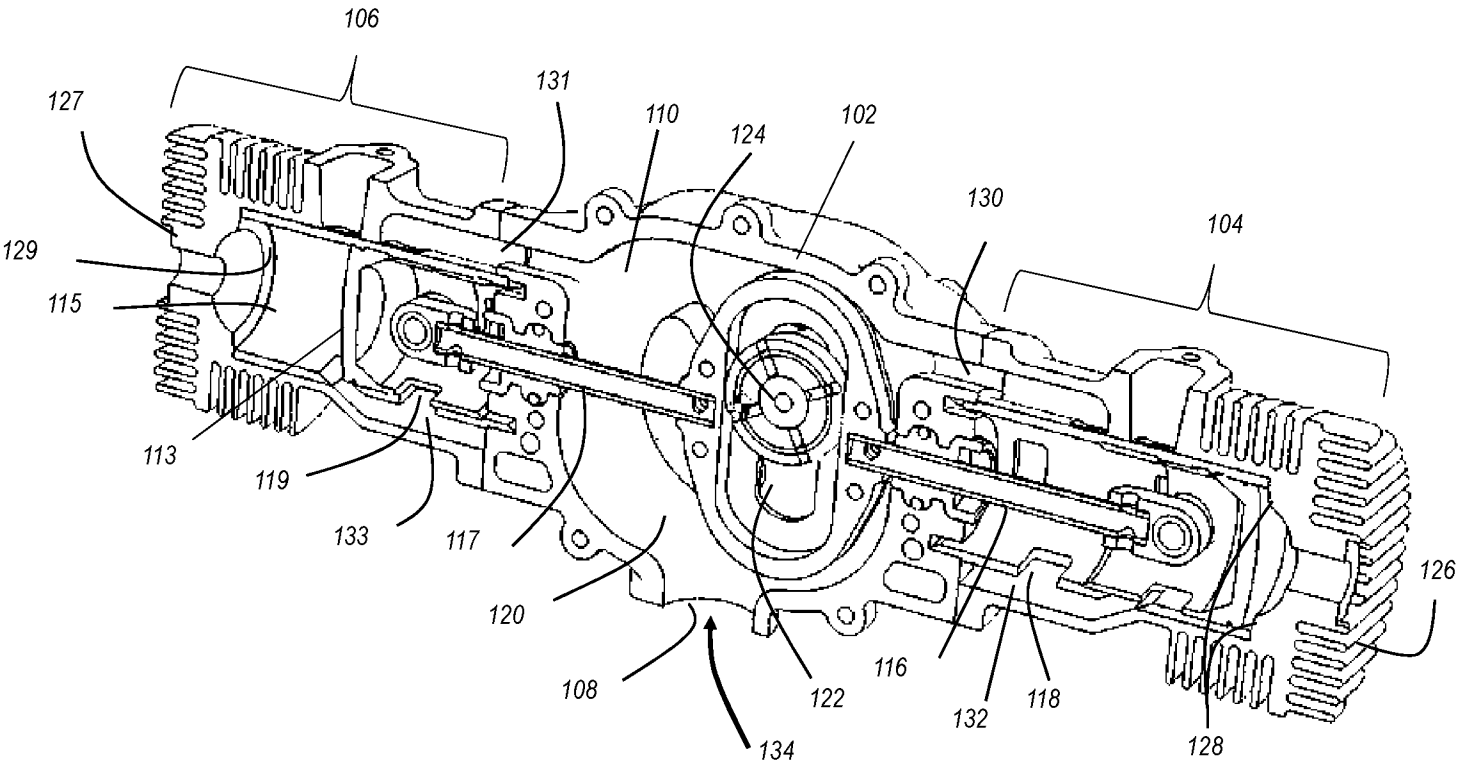
FIG. 3 shows an isometric cutaway view of an internal combustion engine in a third timing state, in accordance with some embodiments.
Figure 4:
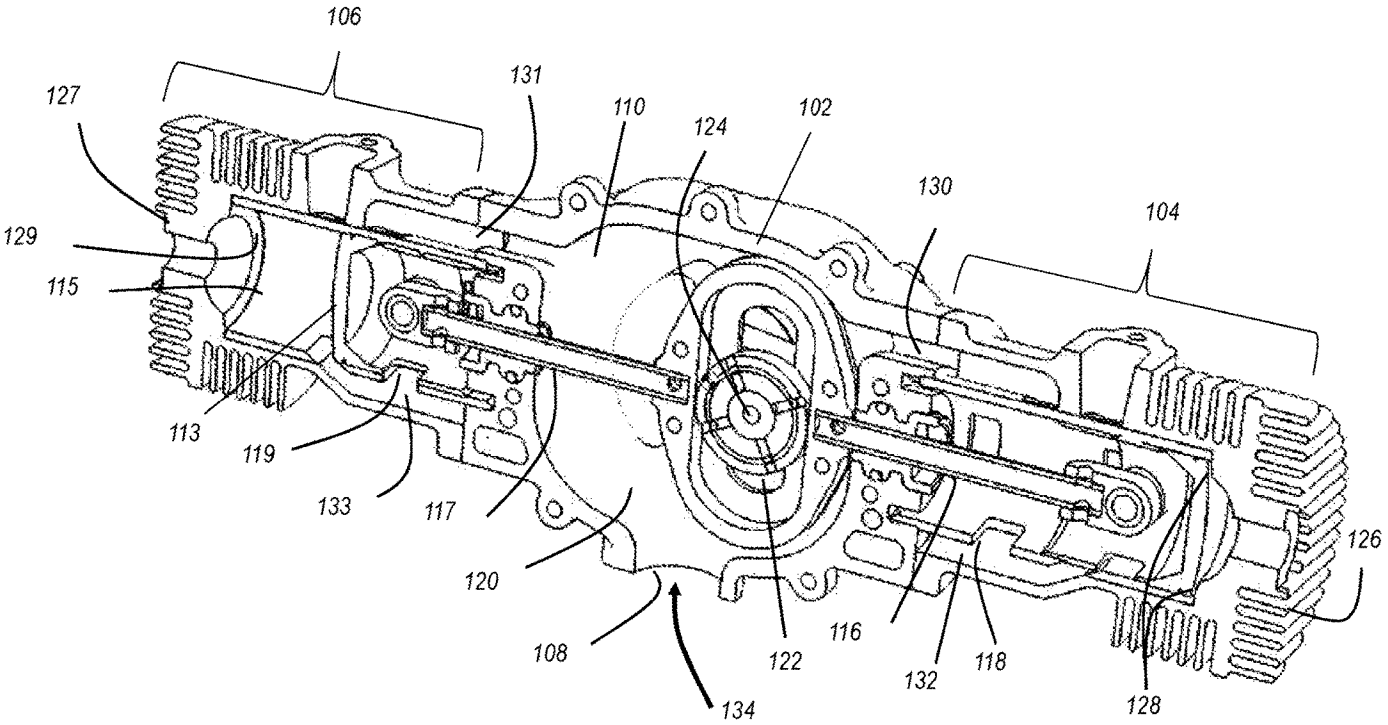
FIG. 4 shows an isometric cutaway view of an internal combustion engine in a fourth timing state, in accordance with some embodiments.

Returning to FIGS. 1-9, the drawings follow a cycle of the internal combustion engine designed in a accordance with some embodiments, and in particular, as a free piston configured engine. Through the sequence of FIGS. 1-9, reference can be made to FIGS. 10-12 for more detailed understanding using common terms. In FIG. 1 it can be seen that the crank throw 124 is approximately at its highest point in the transverse slot 122 of the yoke 120. This represents a position of about ninety degrees from both top dead center and bottom dead center for both pistons 112, 113. In FIG. 2, the timing advances both pistons; piston 112 is now approximately sixty degrees from top dead center, and therefore piston 113 is the same angle from bottom dead center. Piston 113 is in a position where its piston transfer port is aligning with the lower cylinder transfer port of cylinder 115, and piston 112 is sealing off the upper cylinder transfer port and exhaust port of cylinder 114. This continues to FIG. 3, where piston 112 is about thirty degrees from top dead center, and piston 113 is about thirty degrees from bottom dead center. In FIG. 4, piston 112 is at top dead center, as in FIG. 11, and piston 113 is at bottom dead center of its stroke, as in FIG. 12, and the crank throw 124 is midway between top and bottom of the transverse slot 122. In the right cylinder unit 104 the exhaust and upper cylinder transfer ports of cylinder 114 are completely sealed off, and the piston intake port of piston 112 is aligned with the cylinder intake port of cylinder 114, drawing fuel into cylinder 114 under piston 112 due to a vacuum created under piston 112. Above piston 112 compressed fuel may already be undergoing combustion, or is about to start combusting. In some embodiments combustion can be timed, using, for example, a spark plug, to occur at 0-15 degrees before top dead center in each cylinder. In cylinder 115, piston 113 is positioned such that its piston transfer port is aligned with the lower cylinder transfer port, completely allowing the compressed fuel under piston 113 to transfer through transfer channel 133 to an upper portion of cylinder 115, above piston 113, the top of which has cleared the upper cylinder transfer port of cylinder 115.

Figure 5:
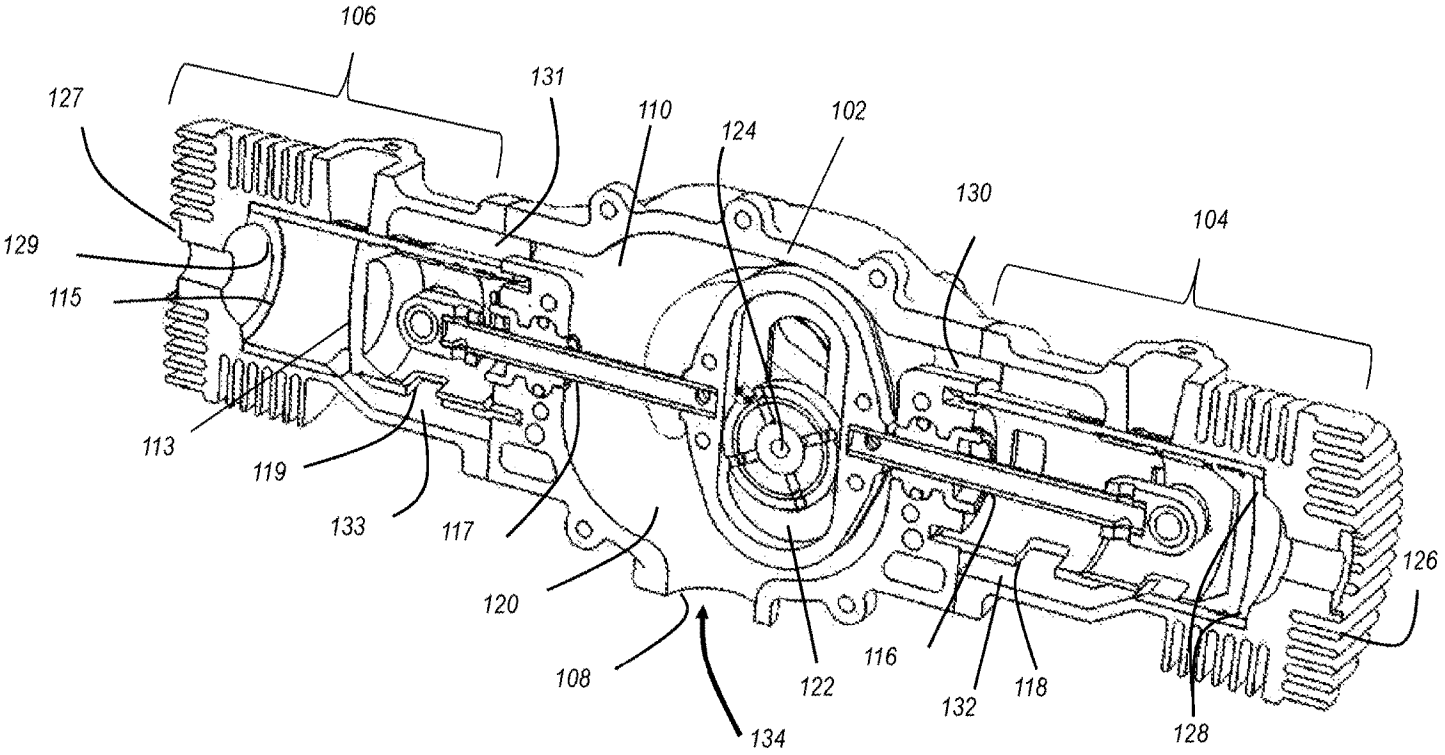
FIG. 5 shows an isometric cutaway view of an internal combustion engine in a fifth timing state, in accordance with some embodiments.
Figure 6:
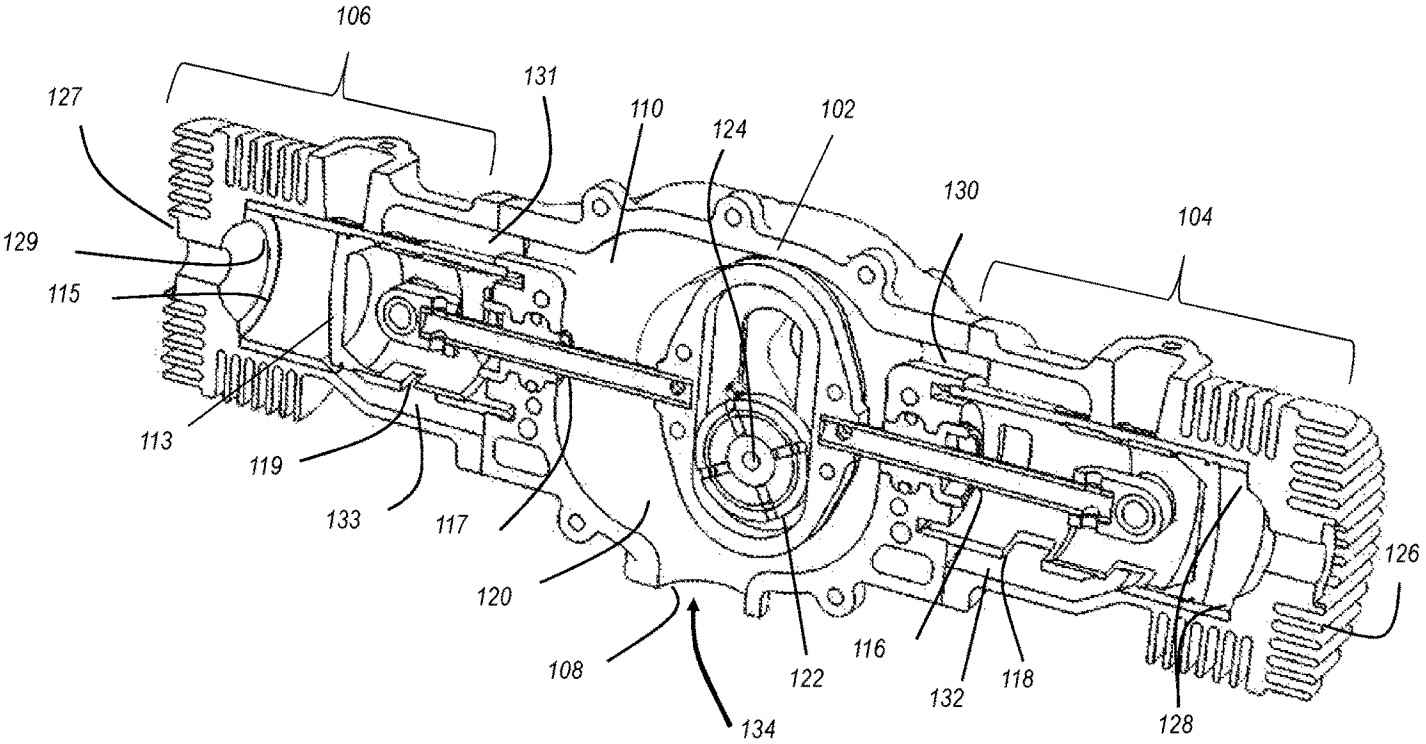
FIG. 6 shows an isometric cutaway view of an internal combustion engine in a sixth timing state, in accordance with some embodiments.
Figure 7:
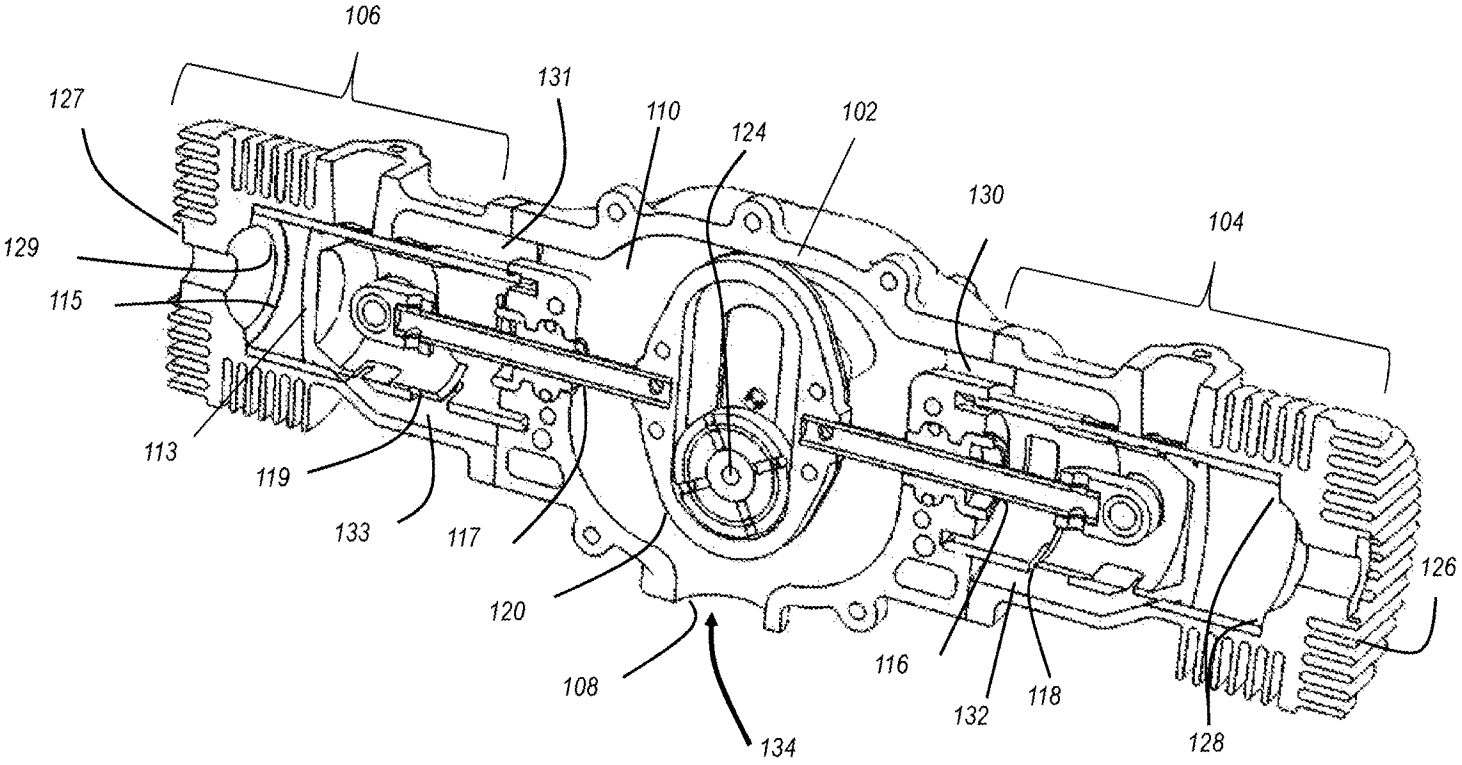
FIG. 7 shows an isometric cutaway view of an internal combustion engine in a seventh timing state, in accordance with some embodiments.
Figure 8:
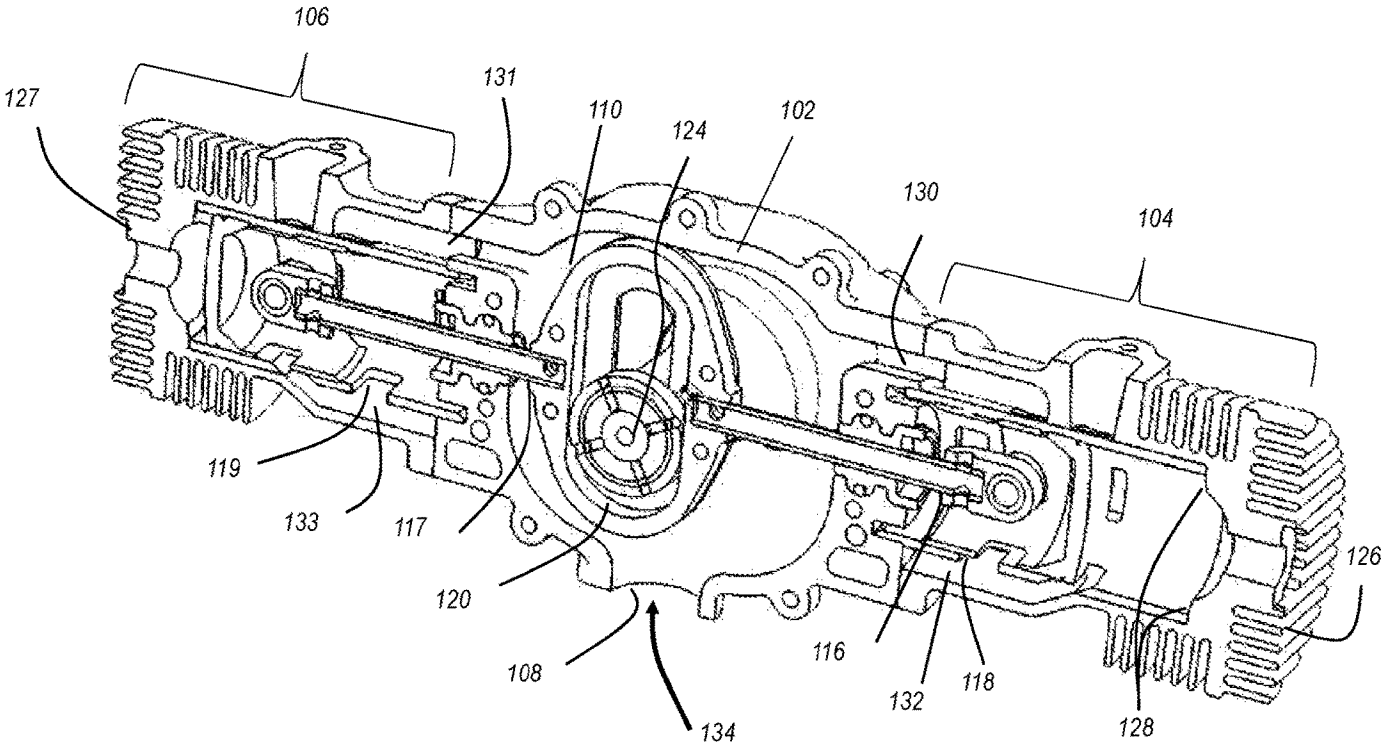
FIG. 8 shows an isometric cutaway view of an internal combustion engine in a eighth timing state, in accordance with some embodiments.
Figure 9:
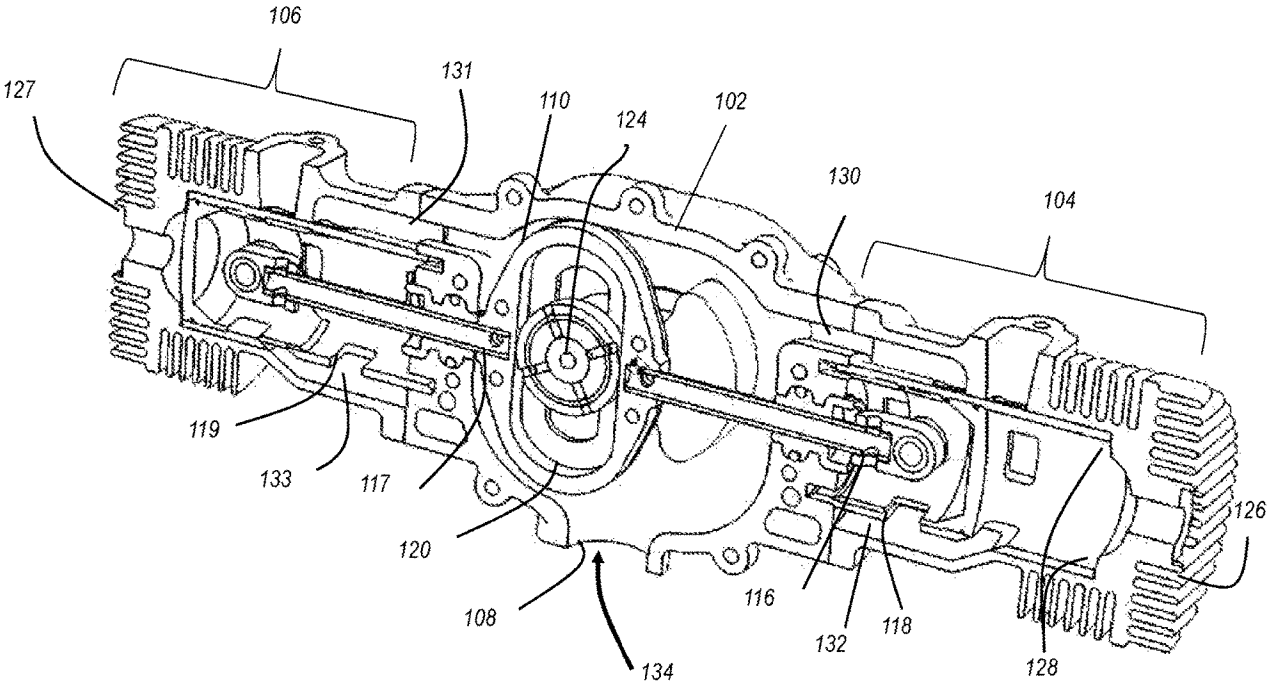
FIG. 9 shows an isometric cutaway view of an internal combustion engine in a ninth timing state, in accordance with some embodiments.

FIGS. 5-6 advance the timing another approximately thirty degrees each. As piston 112 is on its down stroke from top dead center towards bottom dead center, piston 113 is doing the opposite as both pistons' strokes are one hundred eighty degrees offset from each other. In FIG. 7, as in FIG. 1, both piston are ninety degrees from top dead center/bottom dead center. FIGS. 8-9 each advance timing by another approximately forty five degrees each, and thus in FIG. 9, piston 113 is at top dead center, as in FIG. 12, and piston 112 is at bottom dead center, as in FIG. 12, and the crank throw 124 is again in the center of the transverse slot 122.

In FIGS. 1-13, it can be seen that, in some embodiments using two opposing cylinder units, the crankcase intake port is at the bottom of the crankcase, the intake channel in each cylinder unit (e.g. 130, 131) is at the uppermost side of the cylinder (physically, not in terms of stroke angle), and the transfer channel (e.g. 132, 133) is on the lowermost side of the cylinder, opposite the intake channel. Furthermore, the exhaust port in each cylinder is located on the opposite side of the cylinder from the upper cylinder transfer port. As a result, the crankcase is under constant vacuum (e.g. negative pressure). It is also contemplated that a single cylinder embodiment can operate to create a similar crankcase vacuum by operating substantially as disclosed, without the corresponding opposing cylinder. In addition, it should be noted that the cylinder units lack conventional mechanical valves. The operation of the piston skirt as the piston reciprocates in the cylinder, in conjunction with the intake, exhaust, and transfer ports, eliminates the need for conventional valves in the cylinders or crankcase. Since the function of valving is done by the piston skirt, which seals the fuel air charge from the crankcase, then the fuel air charge is highly compressed and not diluted as commonly occurs in conventional two stroke engines that allow the fuel air charge to dissipate back into the crankcase area while being sealed or closed by reed valves or other types of mechanical valving methods from ambient air.

Figure 14:
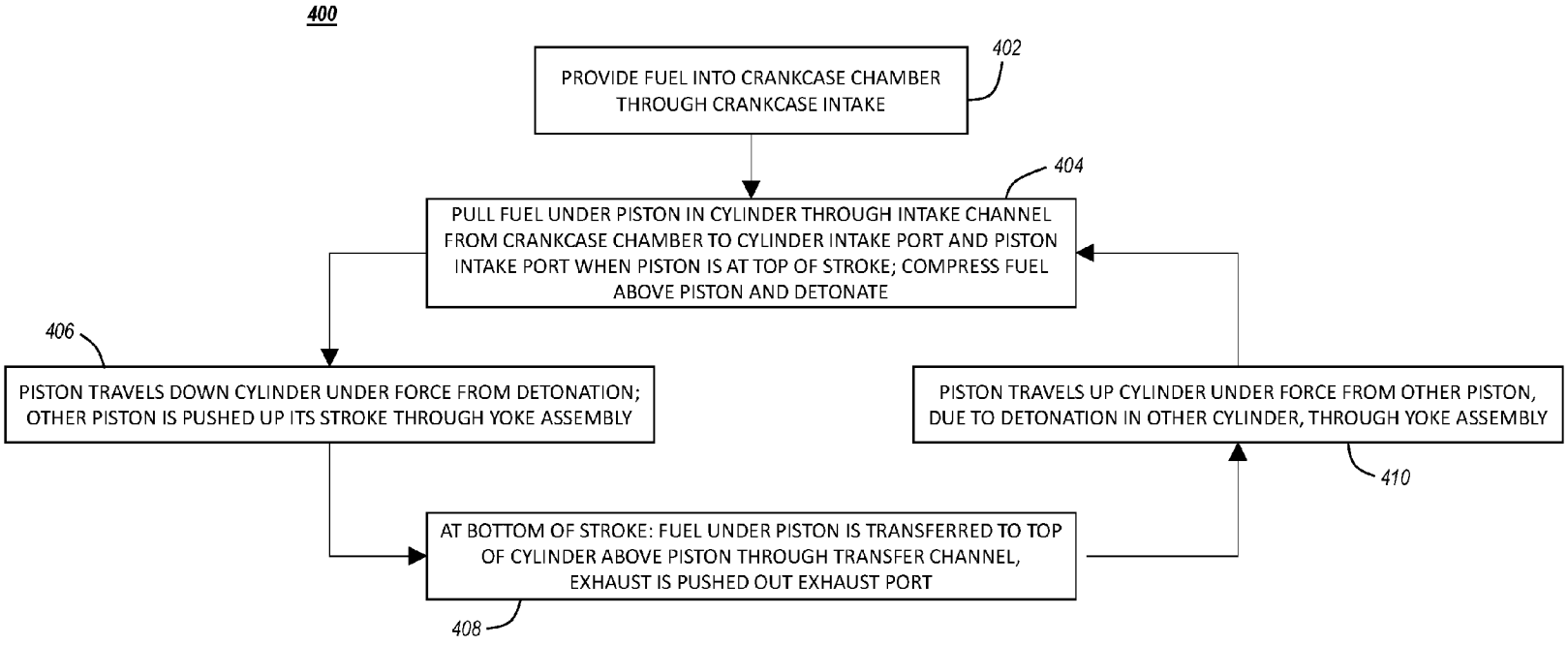
FIG. 14 shows a flow chart of an engine cycle process, in accordance with some embodiments.

FIG. 14 is a flow chart diagram of a method 400 of operating an internal combustion engine in accordance with some embodiments of the invention. The method can apply to any engine configured as shown in FIGS. 1-13, and 15, as well as embodiments having fewer or more cylinder units, and generally comprises an internal combustion engine having opposing cylinder units operating in a free piston configuration, where the pistons in each of the opposing cylinder units are offset by one hundred eighty degrees in their respective strokes relative to each other. Thus, the opposing pistons move laterally in synchronization. It can be assumed that for the method 400 the engine is running, rather than undergoing a startup operation. At step 402 fuel is provided into the crankcase chamber through a crankcase intake port. The crankcase intake port can be located at the bottom of the crankcase as the crankcase can operate without a lubrication sump. Step 402 is ongoing while the other steps 404-410 of method 400 commence. In steps 404-410, the boxes are arranged roughly in a circular, and represent what one of the two pistons is doing at given point in its stroke; the opposing piston will be doing the step directly across the circle. So, for example, while one piston is at step 404, the other piston is at step 408; when one piston is at step 406, the other piston is at step 410.

In step 404 the piston is at the top of its stroke, meaning within about forty five degrees of top dead center. A vacuum is created under the piston, and when the piston intake port is aligned with the cylinder intake port, fuel is pulled into the cylinder under the piston. At the same time, fuel above the piston has been compressed and is detonated. The detonation can occur at top dead center, or within some angle prior to or after top dead center. In some embodiments it has been found that detonation can optimally occur at 0-15 degrees before top dead center. In step 406 the piston is travelling down the cylinder under pressure from the detonation of fuel, and because of the free piston configuration, the opposing piston is being pushed up in its cylinder (e.g. in step 410). In step 408 the piston passes through the bottom of its stroke where the fuel under the piston is compressed, and the exhaust port in the side of the cylinder is exposed/opened. At the same time the piston transfer port aligns with the lower cylinder transfer port and the top of the piston clear the upper cylinder transfer port, allowing the compressed fuel under the piston to transfer to the top of the cylinder above the piston in the cylinder. In step 410 the piston then commences its upstroke, sealing off the upper and lower cylinder transfer ports and exhaust port, and compressing the fuel into the combustion chamber formed by the cylinder head 305. The process of steps 404-410 then keeps repeating. It is important to note that in step 402, the fuel can be a fuel mixture including air and a lubrication component. The action of the yoke and crank can further atomize the fuel mixture, and the lubricating component can provide lubrication to the yoke, piston rods, crank, and crank throw, as well as the pistons as the pistons slide back and forth past the cylinder intake port where some of the fuel mixture can settle.

In general, the internal combustion engine of FIGS. 1-13, and the method of operation outlined in FIG. 14 results in an engine that has a constant vacuum in the crankcase. When each piston reaches the bottom of its stroke, the fuel-air mixture under it is transferred to the top of the cylinder. From the bottom, the piston is then pushed up in cylinder bore by the detonation in the opposing cylinder, through the piston rods and yoke linkage, creating a vacuum under the piston, which, at the top of the stroke, pulls in fuel-air from the crankcase chamber, through the intake channel. This is then repeated by the opposing cylinder. As no gasses flow back into the crankcase chamber, the crankcase chamber experiences a constant vacuum. This allows the fuel-air mixture to be pulled in the crankcase chamber from an intake manifold, rather than, for example, using individual carburetors or fuel injectors in each cylinder where blowby gasses would produce increased crankcase pressure, as in conventional internal combustion engines.

Figure 15:
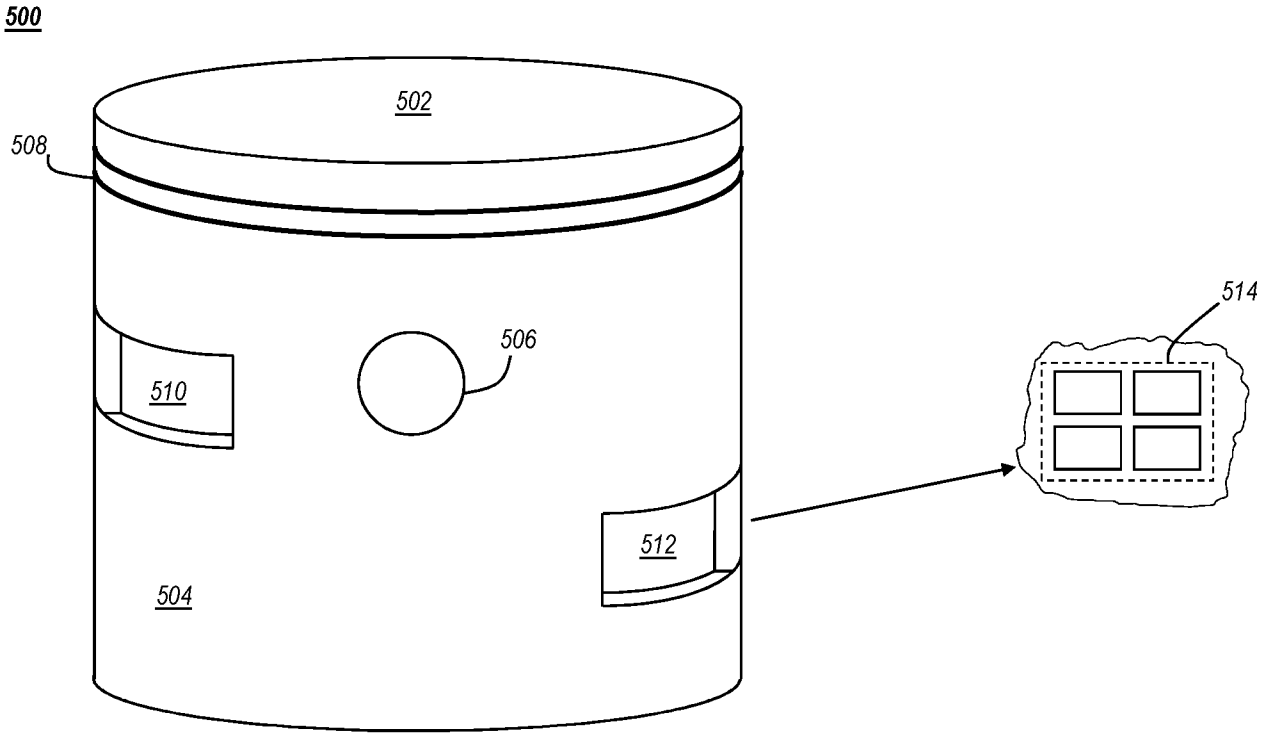
FIG. 15 shows an isometric view of a piston for use in an internal combustion engine, in accordance with some embodiments.

FIG. 15 shows an isometric view of a piston 500 for use in an internal combustion engine in accordance with some embodiments. The piston 500 has a top 502 or top surface. One or more compression piston rings 508 can be disposed in the side or skirt 504 of the piston 500. A connecting rod 506 allows the piston 500 to be coupled to a piston rod. The skirt 504 has a piston intake port 510 and a piston transfer port 512 formed through the skirt 504, which allow fuel to pass through ports 510, 512 in accordance with the forgoing description in FIGS. 1-14. The ports 510, 512 are shown generally as rectilinear shaped, but can be provided in other shapes as well. However the top and bottom edges of the ports 510, 512, can be parallel to the top edge of the piston 500, and correspond generally with the cylinder intake port and lower cylinder transfer port, respectively. In some embodiments, the ports 510, 512 can be windowed 514, formed of several holes grouped together, to retain some rigidity in the side/skirt 504 of the piston 500.

The inventive internal combustion engine embodiments provide technological improvements over known engine configurations, including the creation of a continuous vacuum in the crankcase chamber that allows fuel to be pulled into the crankcase. Advantageously, one of the pistons is always moving away from the chamber and creating a vacuum as it does so. The opposing piston moving towards the chamber is not pressurizing the chamber because it is not fludically connected to the chamber because the piston skirt block the port. Instead, the air/fuel mixture beneath the piston is being transferred around the piston and to the top of the piston inside the cylinder with each stroke. The engine lacks a lubrication sump and instead mixes fuel with oil. In fact, unlike prior art engines of similar configuration, the inventive engine disclosed herein can operate on standard commercial gasoline, and the fuel mixture provides lubrication to the various engine parts. Furthermore, the disclosed design and method of operation eliminates the need for any type of mechanical valving within the crankcase area. Since the valving is done by the piston skirt and seals the fuel air charge from the crankcase, then the fuel air charge is highly compressed and not diluted as seen in conventional two stroke engines that allow the fuel air charge to dissipate back into the crankcase area while being sealed or closed by reed valves or other types of mechanical valving methods from ambient air.

What is claimed is:

1. An internal combustion engine, comprising:

a crankcase having a crankcase chamber;

a pair of opposing cylinder units disposed on opposing sides of the crankcase along an axis, each cylinder unit include a cylinder with a piston disposed therein, each piston having a skirt and being coupled to a piston rod that is oriented along the axis from the cylinder into the crankcase chamber;

a yoke disposed in the crankcase chamber to which each of the piston rods are coupled on opposite sides of the yoke; and for each cylinder unit, an intake channel passing from the crankcase chamber to a respective cylinder intake port in the cylinder, wherein a piston intake port aligns with the cylinder intake port when the piston is at the top of a stroke in the cylinder, and is sealed off by the skirt otherwise and wherein fuel is drawn under the piston in the cylinder by a vacuum created under the piston as the piston moves up in the cylinder, each cylinder unit further having a transfer channel between a lower cylinder transfer port and an upper cylinder transfer port in the cylinder through which fuel is transferred from under the piston through a piston transfer port to a top of the cylinder above the piston when the piston at a bottom of the stroke;

wherein action of the pistons oscillating laterally along the axis in opposition to each other creates a substantially continuous vacuum in the crankcase chamber.

2. The internal combustion engine of claim 1, further comprising a crankcase intake port through which fuel is introduced into the crankcase chamber, and wherein a stroke of each piston draws fuel from the crankcase chamber, though the intake channel, cylinder intake port, and piston intake port under the piston in each cylinder unit at the top of the stroke.

3. The internal combustion engine of claim 2, wherein, in each cylinder unit, fuel is compressed under the piston as the piston traverses from the top to the bottom of the stroke, whereupon the compressed fuel escapes under pressure resulting from the compression through a piston transfer port and lower cylinder transfer port, through the transfer channel and upper cylinder transfer port into a top of the cylinder.

4. The internal combustion engine of claim 3, wherein the upper transfer port in each cylinder is sealed off by the skirt of the piston except when the piston is at the bottom of the stroke.

5. The internal combustion engine of claim 2, further comprising:

the yoke having a transverse slot therein; and a crank in the crankcase chamber having a crank throw disposed in the transverse slot of the yoke, wherein the crank throw reciprocates transversely in the slot as the pistons and piston rods reciprocate longitudinally, and wherein the crank throw thereby follows a circular path within the crankcase thereby imparting a rotational force to the crank;

wherein the fuel includes a lubricating component that lubricates the yoke, crank, crank throw, piston rods in the crankcase chamber, and to the pistons through the respective intake channels.

6. The internal combustion engine of claim 2, wherein the fuel comprises gasoline mixed with oil.

7. The internal combustion engine of claim 1, further comprising:

each cylinder unit further having a cylinder head that defines a combustion chamber at the top of the cylinder, and wherein the cylinder head forms a squish band around a circumferential perimeter of the combustion chamber.

8. The internal combustion engine of claim 1, wherein as the piston in each cylinder rises, a detonation of the fuel above the piston occurs prior to the piston reaching a top dead center point of its stroke.

9. A continuous vacuum engine, comprising:

a crankcase having a crankcase chamber with a fuel intake port through which a fuel mixture is introduced into the crankcase chamber;

at least one cylinder unit, each of the at least one cylinder comprising:

a cylinder having a cylinder bore and a cylinder wall;

an intake channel formed between the crankcase chamber to a cylinder intake port in the cylinder;

a transfer channel formed between a lower cylinder transfer port at a lower end of the cylinder and an upper cylinder transfer port at an upper end of the cylinder;

a piston disposed in the cylinder bore having a skirt, a skirt intake port formed in the skirt that aligns with the cylinder intake port when the piston is at a top of a stroke within the cylinder, and a skirt transfer port formed in the skirt that aligns with the lower cylinder transfer port when the cylinder is at a bottom of the stroke;

a yoke disposed in the crankcase chamber;

a piston rods connected between a side of the yoke and the piston through the crankcase, where the pistons rod, piston, and yoke move along an axis together, and wherein the action of the piston creates a continuous vacuum in the crankcase chamber; and a crank having a crank throw disposed in a transverse slot of the yoke.

10. The continuous vacuum engine of claim 9, wherein the crankcase lacks a lubrication sump, and lubrication is provided by a lubrication component in the fuel mixture.

11. The continuous vacuum engine of claim 9, wherein a stroke of each piston draws the fuel mixture from the crankcase chamber, though the intake channel, cylinder intake port, and skirt intake port under the piston in each cylinder unit at the top of the stroke.

12. The continuous vacuum engine of claim 11, wherein, in each of the at least one cylinder unit, the fuel mixture is compressed under the piston as the piston traverses from the top to the bottom of the stroke, whereupon the fuel mixture escapes under pressure resulting from the compression through the skirt transfer port and lower cylinder transfer port, through the transfer channel and upper cylinder transfer port into a top of the cylinder.

13. The continuous vacuum engine of claim 12, wherein the transfer channel of each cylinder unit is angled at the upper cylinder transfer port to direct the fuel mixture towards a top of the cylinder.

14. The continuous vacuum engine of claim 9, wherein the fuel mixture comprises gasoline mixed with oil.

15. The continuous vacuum engine of claim 9, further comprising:

each cylinder unit further having a cylinder head that defines a combustion chamber at the top of the cylinder, and wherein the cylinder head forms a squish band around a circumferential perimeter of the combustion chamber.

16. The continuous vacuum engine of claim 9, wherein the at least one cylinder unit comprises two opposing cylinder units disposed on opposite sides of the crankcase.

17. A method of operating an internal combustion engine, the engine including a crankcase having a crankcase chamber and a fuel intake port through which a fuel is provided into the crankcase chamber, at least one cylinder unit mounted on the crankcase, each of the at least one cylinder unit including a cylinder having a piston disposed therein, and a piston rod connected to the piston that passes from the cylinder into the crankcase chamber to a yoke in the crankcase chamber, the method comprising:

providing a fuel into the crankcase chamber through the fuel intake port of the crankcase; in each cylinder unit:

pulling fuel from the crankcase chamber into the cylinder through an intake that passes from the crankcase chamber to a cylinder intake port in the cylinder by action of a vacuum created under the piston when the piston travels to a top of a stroke within the cylinder, wherein a skirt intake port in a skirt of the piston aligns with the cylinder intake port when the piston at the top of the stroke;

wherein, when the piston in each of the at least one cylinder unit is at the top of the stroke, there is compressed fuel mixture above the piston in the cylinder, compressing fuel under the piston by action of the piston traversing a down in the stroke as compelled by the fuel above the piston igniting; and transferring the compressed fuel under the piston to a top of the cylinder above the piston when the piston is at a bottom of the stroke through a transfer channel, wherein a skirt transfer port of the piston aligns with a lower cylinder transfer port of the transfer channel at the bottom of the stroke;

wherein a constant vacuum is created in the crankcase chamber by action of the cylinder in the pulling and transferring steps.

18. The method of claim 17, wherein the engine lacks a lubrication sump, the method further comprising providing a lubrication component into the fuel as it passes into the crankcase chamber.

19. The method of claim 17, wherein transferring the compresses fuel comprises directing the fuel to a top of the cylinder through an angled portion of the transfer channel at an upper cylinder transfer port when the piston is at the bottom of the stroke.

20. The method of claim 17, further comprising, after transferring the compressed fuel, compressing the fuel into an ignition chamber formed by a cylinder head of the cylinder unit, including driving the fuel into the ignition chamber from a squish band formed around a circumferential perimeter of the ignition chamber in the cylinder head.

* * * * *